United States Patent [19]

Pompei

[11] 4,141,329

[45] Feb. 27, 1979

[54] INTERNAL COMBUSTION ENGINE FUEL INJECTION SYSTEM

[75] Inventor: Francesco Pompei, Wayland, Mass.

[73] Assignee: Foster-Miller Associates, Inc., Waltham, Mass.

[21] Appl. No.: 681,777

[22] Filed: Apr. 30, 1976

[51] Int. Cl.[2] ..... F02M 39/00; F02M 42/00

[52] U.S. Cl. ..... 123/139 B; 123/139 AK; 417/469; 417/492; 239/91; 417/499

[58] Field of Search ..... 123/33 C, 139 R, 139 AD, 123/139 AE, 139 B, 139 AK, 139 AT, 139 DP, 32 JV, 139 BF; 417/492, 493, 499, 469; 239/88, 91, 92

[56] References Cited

U.S. PATENT DOCUMENTS

| | | | |
|---|---|---|---|
| 1,208,012 | 12/1916 | Riotte | 123/139 AK |
| 1,511,484 | 10/1924 | Peterson | 239/88 |
| 1,573,248 | 2/1926 | Johnsen | 123/139 AK |
| 1,677,202 | 7/1978 | Olsen | 123/139 AK |
| 1,967,101 | 7/1934 | Rassbach et al. | 123/139 R |
| 1,973,146 | 9/1934 | Gill | 123/139 R |
| 2,357,870 | 9/1944 | Beeh | 417/492 |
| 2,375,906 | 5/1945 | Falcon | 239/88 |
| 2,727,498 | 12/1955 | Reiners | 123/32 |
| 2,731,917 | 1/1956 | Evans | 123/139 R |
| 3,125,078 | 3/1964 | Reiners | 123/139 AK |
| 3,146,949 | 9/1964 | Reiners | 239/92 |
| 3,810,453 | 5/1974 | Wolfe | 123/139 AT |
| 3,965,875 | 6/1976 | Perr | 123/139 R |

*Primary Examiner*—William R. Cline
*Assistant Examiner*—H. Jay Spiegel
*Attorney, Agent, or Firm*—Morse, Altman, Oates & Bello

[57] ABSTRACT

A fuel injection system is disclosed for an internal combustion engine having at least one cylinder and a piston operating therein to define with the cylinder head a combustion chamber wherein air is compressed while the piston is moving to one end of its stroke. The system has pressurizing means adjacent the combustion chamber which suddenly further compresses in a compression chamber a small part of the air precompressed in the combustion chamber to a substantially higher pressure and temperature than the peak pressure and temperature of air in the combustion chamber. Fuel feed means supplies fuel to the compression chamber, and nozzle means is operative to substantially confine the air in the compression chamber during its compression and to discharge the compressed air-fuel mixture as a jet into the combustion chamber.

13 Claims, 12 Drawing Figures

FIG 5
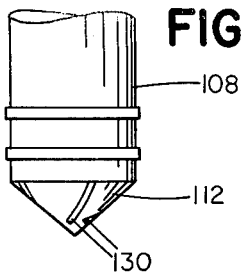
FIG 6
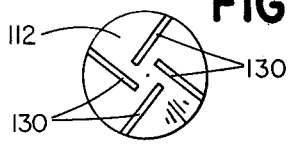
FIG 7A
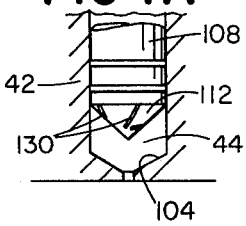
FIG 7B
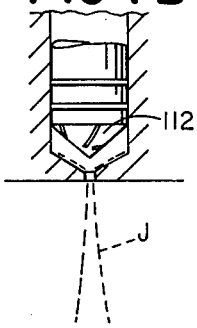
FIG 7C
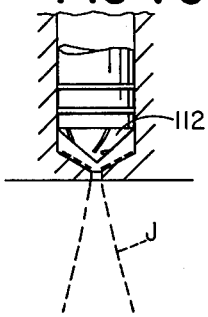
FIG 7D
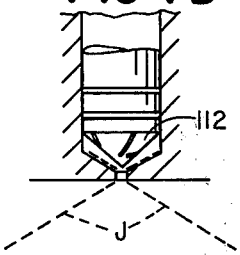
FIG 7E
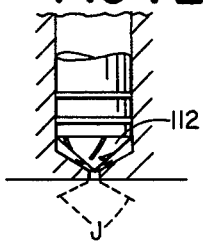
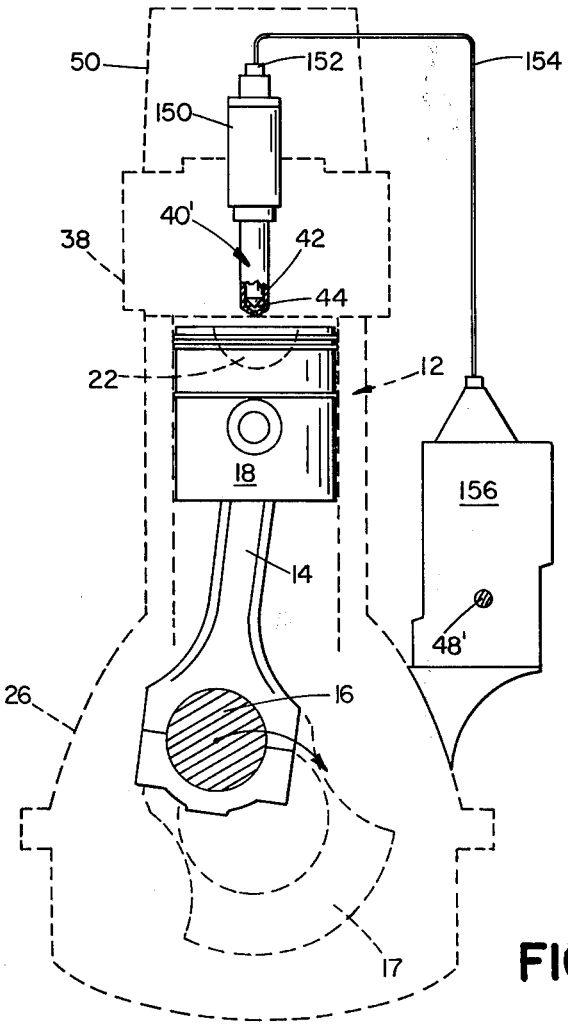
FIG 8

INTERNAL COMBUSTION ENGINE FUEL INJECTION SYSTEM

BACKGROUND OF THE INVENTION

1. Field of the Invention

This invention relates to internal combustion engines and is particularly applicable to such engines of the Diesel or stratified charge type.

2. Description of the Prior Art

Despite their greater economy in amount and cost of fuel used, Diesel engines have made little headway in replacing spark-fired gasoline engines as the power unit of automobiles. This has been due largely to the relatively lower efficiency of existing Diesel engines on a power to weight ratio, their higher initial cost, lower maximum speed and special fuel requirements, without any offsetting advantage in noxious emissions. Heavy duty Diesel engines for other applications suffer from similar problems. It is believed that the greatest weakness of today's Diesel engine is its lack of an adequately effective fuel injection-ignition system.

Early Diesel engines utilized compressed air to vaporize and inject fuel into the combustion chambers at the top of the cylinders. This system worked well, but required multi-stage compressors to compress the air to from 800 to 1300 p.s.i., which added to the complexity, weight, power drain and cost of the engine. Consequently, manufacturers of modern Diesel engines have discarded air pressure fuel injection in favor of pressurized fuel injection systems, in which the required hydraulic pressure of several thousand p.s.i. on the fuel can be generated with less costly, heavy and power consuming equipment. But the "solid" pressurized fuel jet so produced does not produce as rapid and uniform burning of the fuel as would be desirable. Studies indicate that ignition tends to develop at the air-jet interface of the air envelope about the jet, with the fuel not yet adequately mixed with air, so that some ignition "pockets" are overrich in fuel and tend to generate smoke and odor due to insufficient oxidation, fuel cracking and carbonization. Other ignition pockets are too lean in fuel, tending to generate unburned hydrocarbons and odorous compounds. Both conditions impair engine performance, which ideally needs combustion at nearly a constant fuel-air ratio to the lean side of the stoichiometric, without delays due to erratic burning.

To alleviate these difficulties with pressurized fuel injection, it has been proposed, as in U.S. Pat. No. 2,046,003, to provide a cone of compressed air surrounding the jet as it passes into the combustion chamber, the compression being provided by individual pumps for each cylinder, operated by the cam shaft. The arrangements proposed have not been such as to provide compressed air at a pressure or temperature much above that prevailing in the combustion chamber. Adequacy and speed of combustion in the area surrounding the jet are possibly improved, but the internal, relatively "solid" area of the jet is not greatly effected, and this still gets ignited without adequate mixing with air.

SUMMARY OF THE INVENTION

An object of this invention is to provide an improved fuel injection system for internal combustion engines in which compressed air at high pressure and temperature injects the fuel into the combustion chamber in atomized state thoroughly mixed with the air, so that ignition occurs substantially uniformly and without the burning irregularities which have characterized and impaired the performance of pressurized fuel injection systems. Another object is to provide such a system which utilizes relatively simple, inexpensive apparatus that has low cost and power drain advantages comparable to those of pressurized fuel injection systems.

A fuel injection system attaining the foregoing objects has a pressurizing device adjacent the combustion chamber of each cylinder, this device having a compression chamber and compression means operative to suddenly further compress in the compression chamber a relatively small part of the air precompressed in the combustion chamber by the cylinder piston to a substantially higher pressure and temperature than the peak air pressure and temperature of air compression by the cylinder piston. Fuel feed means supplies combustible fuel to the compressed body of air in the compression chamber, and nozzle means, communicating the compression chamber with the combustion chamber, substantially confines the air in the compression chamber during the compression thereof and then discharges the air mixed with fuel as a jet into the combustion chamber.

In preferred embodiments, the combustion chamber is a bowl in the end of the cylinder piston; the air in the compression chamber is compressed to a pressure at least 100 p.s.i. above the peak pressure, and at least 200° F. above the peak temperature, of air precompressed in the combustion chamber by the cylinder piston; the compression means is a piston reciprocable in the compression chamber and operated by the engine cam shaft or hydraulically; and the nozzle means is an orifice in the chamber in constant communication with the combustion chamber, the diameter of the orifice being so small in relation to the volume of the compression chamber as to substantially confine the air displaced in the compression chamber during the sudden compression stroke of the piston therein, thereby permitting the temperature and pressure of the air to increase as indicated above.

Also, in preferred embodiments the fuel is metered onto a conical surface surrounding the nozzle orifice in the compression chamber so that the air compressed by the piston is forced over the fuel to atomize and mix with it as it ejects from the orifice; and the compression piston is provided with structure which produces a swirling motion in the compressed air as it discharges from the compression chamber. The fuel metering system may advantageously include a metering piston and control sleeve coaxial with the compression piston and operated in conjunction therewith.

The jet supplied is at high temperature, substantially above that in the combustion chamber, and its great energy insures that as it expands into the combustion chamber it is thoroughly mixed, so that ignition will occur within rather than peripherally of the jet, and burning proceeds more uniformly with less differential of overrich and overlean pockets than in pressurized fuel injection. In addition, the high temperature of the injected mix provides earlier ignition than would otherwise occur. In consequence, not only can the efficiency of the engine be improved but also its emissions deleterious to the ecology are greatly diminished, the engine operates more smoothly, starts more easily, and may operate with poorer fuels. The required apparatus is not costly or complicated to manufacture as compared with conventional pressurized fuel injection equipment. Its power drain can be less than 1% of engine shaft power at maximum drive speed, which may be substantially compensated by power no longer required for pressurizing fuel for injection.

BRIEF DESCRIPTION OF THE DRAWINGS

In the drawings:

FIG. 5 is a side elevation view of the tip of the air compression piston, showing a preferred construction;

FIG. 6 is a bottom plan view of the piston tip construction of FIG. 5;

FIGS. 7A to 7E are diagrammatic views of the piston tip of FIG. 5, illustrating the action thereof at successive positions during a fuel injection cycle; and FIG. 8 is a diagrammatic elevation view, partly in section, of an alternative arrangement for powering the fuel injection apparatus of FIG. 1.

DESCRIPTION OF THE PREFERRED EMBODIMENTS

Figure 1:
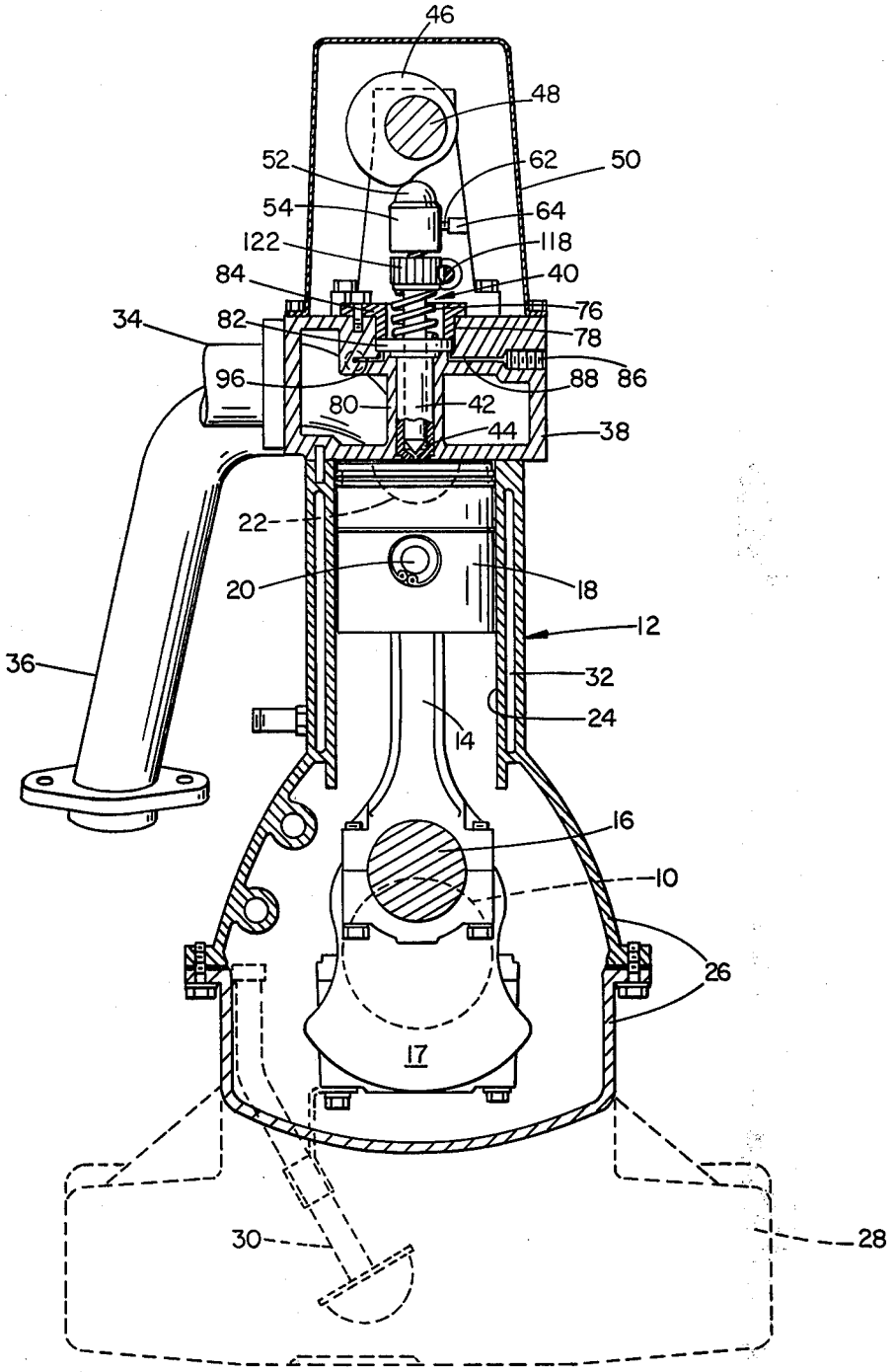
FIG. 1 is a transverse section view, with some parts omitted, through a diesel engine of conventional form but modified by inclusion of a fuel injection system according to the invention.

Referring to FIG. 1, the Diesel engine therein shown is a four stroke engine in which fuel injection takes place on every other stroke. Its crankshaft rotates about an axis centered on the dash line circle 10, and the cylinder shown, designated generally 12, has a connecting rod 14 reciprocable therein, pivotally mounted on one of the eccentric arms 16 of the crankshaft, opposite crankshaft counterbalance 17. Piston 18 is pivotally mounted by wrist pin 20 on connecting rod 14 and has formed at its outer end a bowl shaped combustion chamber 22 in which air is compressed on the upstroke of the piston by virtue of the close fit with the internal bore lining 24 of the cylinder.

The crankshaft housing or engine block 26 which carries the cylinders is supported on crank case 28 having the usual lubricating oil pump pickup 30. A cooling jacket 32 around the cylinder is connected to a source of circulated cooling water (not shown). Air inlet pipe 34 and exhaust pipe 36 are exposed to the cylinder interior at proper intervals by the usual poppet valves (not shown) operated by the crankshaft, and are as usual connected respectively to intake and exhaust manifolds (not shown). At top dead center position shown in FIG. 1, the piston has close clearance with the underside of the cylinder head 38 so that essentially all the air between the piston and the cylinder head is compressed in the combustion chamber 22 during the upstroke of the piston to top dead center. The peak pressure and temperature of air so obtained in the combustion chamber may be of the order of 500 to 1000 p.s.i. and degrees F., respectively.

The fuel injection system according to the invention includes a piston assembly designated generally 40, operating in a fixed sleeve 42 fixedly mounted in cylinder head 38 immediately above cylinder 12, there being one such assembly provided for each cylinder of the engine, one only being shown and described herein as they are all alike. The lower end of sleeve 42 forms the compression chamber 44 of the system. The piston assembly 40 is operated in this embodiment by a cam 46 on the engine cam shaft 48 rotatably mounted on support structure 50 on the cylinder head 38, and which is connected for rotation at one-half the speed of the crank shaft. Cam 46 acts on ball 52 which is rotatable in a socket in the end of piston stem cap 54. The detail of construction and operation of the psiton assembly will be better understood from the enlarged views of FIGS. 2–4, to which reference will now be had.

Figure 2:
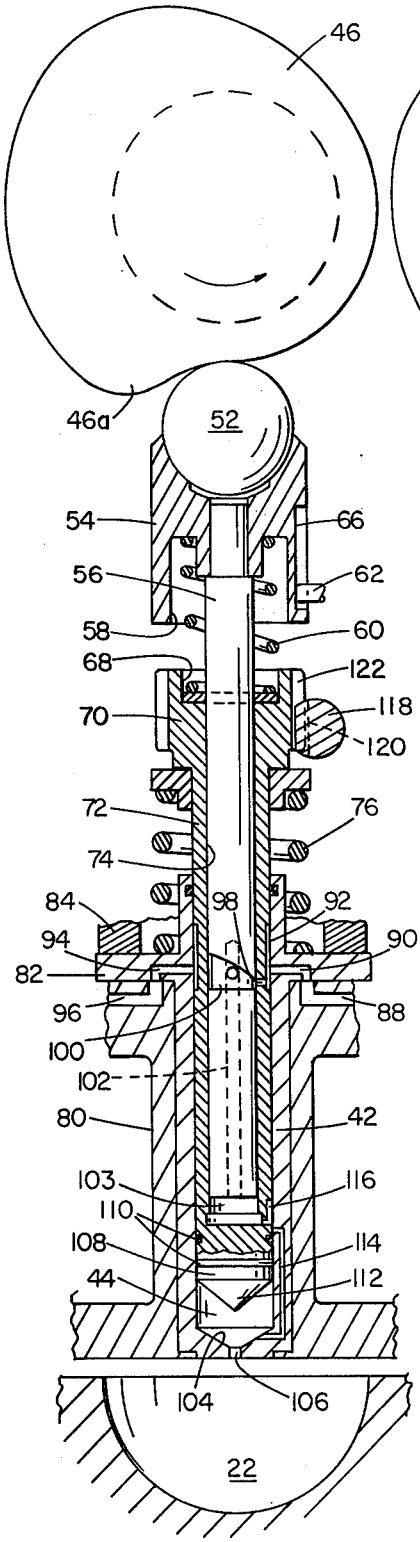
FIGS. 2–4 are enlarged partial vertical section views through the upper part of the apparatus shown in FIG. 1, illustrating successive positions of the piston in the compression chamber and of the fuel metering equipment relative to cylinder piston during a fuel injection cycle.

Referring particularly to FIG. 2, cap 54 has fixed internally thereto the reduced end of the stem of a fuel metering piston 56. Cap 54 has a hollow portion 58 surrounding the end of piston 56 secured thereto, in which one end of a coil spring 60 is seated. A pin 62 secured to a support 64 on structure 50 (see FIG. 1) extends into a longitudinal groove 66 in cap 54 and is slidable therein while retaining piston 56 against rotation. The opposite end of spring 60 is received in a hollow portion 68, surrounding the stem of piston 56, of a cap 70 secured to the upper end of an air compression piston 72 having a longitudinal bore 74 in which the stem of piston 56 is axially slidable. The other end of cap 70 is secured to one end of a coil spring 76 the other end of which is seated in a cavity 78 (FIG. 1) in cylinder head 38, spring 76 having greater resistance to compression than spring 60.

As shown in FIG. 1, sleeve 42 is received in a tubular casing 80 formed in cylinder head 38 extending through the head from the bottom of cavity 78, and is provided near its top with an annular mounting flange 82 which seats in the bottom of cavity 78 and on which one end of spring 76 rests. A clamp sleeve 84 bolted to the cylinder head retains sleeve 42 in position. A port 86 in cylinder head 38 receives a connection from a fuel pump (not shown) and communicates by a passage 88 in head 38 with a passage 90 in flange 82.

Piston 72 is axially slidable in sleeve 42. It is provided with a peripheral annular slot 92 that communicates with passage 90 at all positions of piston 72, and similarly communicates with a passage 94 in flange 82 which in turn communicates with a passage 96 in cylinder head 38 leading to a return line (not shown) to the fuel tank. The arrangement contemplates constant circulation of fuel from the fuel pump through the passages 88, 90, 92, 94, 96 and back to the fuel tank. A port 98 in the shank of piston 72 communicates at times, as hereinafter described, with a peripheral slot 100 in the shank of piston 56, slot 100 having an upper wall curved helically about the piston axis so that the slot widens around the piston clockwise in FIG. 2 for a purpose hereinafter described. A central bore 102 in the shank of piston 56 communicates slot 100 through the head of piston 56 with the bottom of bore 74 which forms the fuel metering chamber 103.

The inner base 104 of sleeve 42 is conically dished with an air-fuel jet discharge port 106 at its apex. The solid head 108 of piston 76, provided with peripheral pressure sealing rings 110, has a complementary conically convex tip 112. One or more passages 114 in sleeve 42 communicate tangentially at one end with base 104 and at the other end communicate at times as hereinafter explained with fuel metering chamber 103 via port 116 in the surrounding portion of piston 72.

A rack 118 arranged to be reciprocated transversely to the piston assembly axis by operator control of the throttle, has a toothed face 120 which meshes with a toothed pinion ring 122 on the periphery of cap 70 of piston 72. Reciprocation of rack 118 therefore rotates piston 72 about piston 56 (held against rotation by pin 62) so that port 98 can be moved between the position shown in the Figures opposite the narrow end of slot 100 (which corresponds to maximum fuel charge), and a position opposite the wide end of slot 100 (which corresponds to minimum fuel charge).

Figure 3:
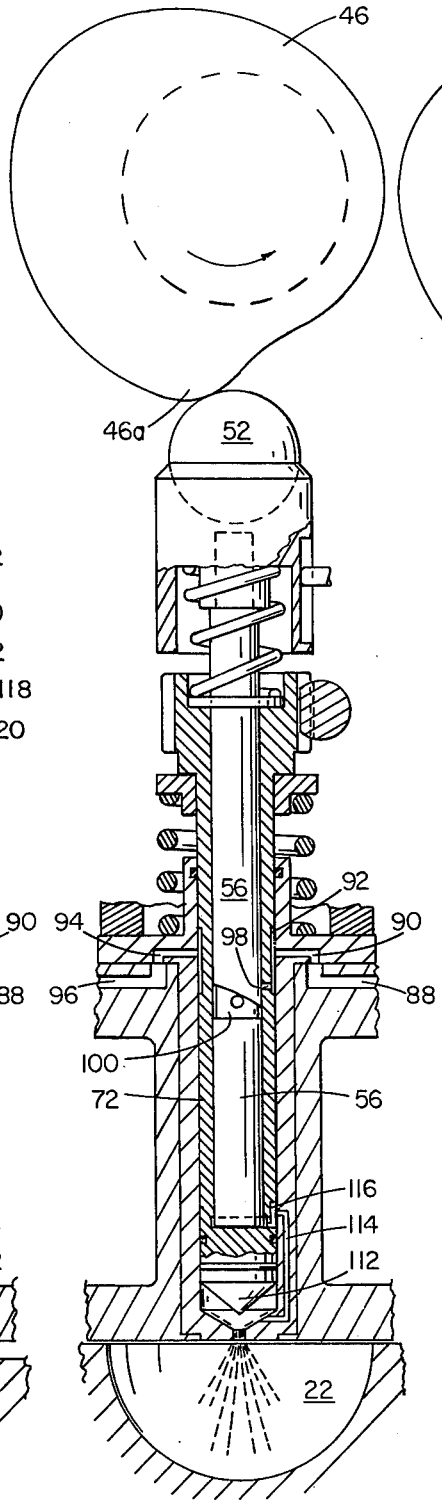
Figure 4:
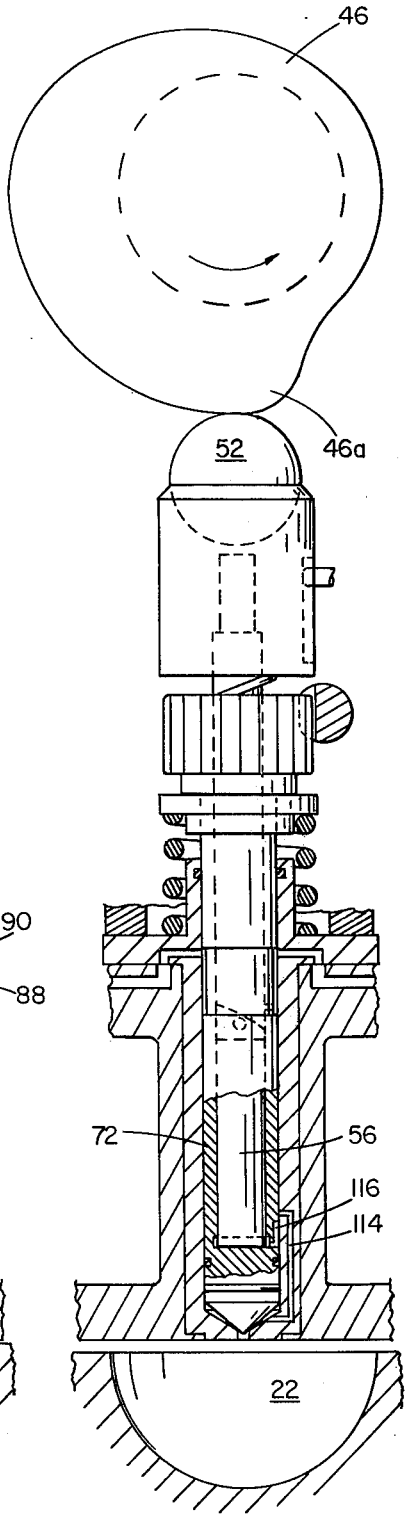

FIGS. 2 to 4 illustrate the operation of the piston assembly as the crankshaft moves piston 18 from minus 40° of top dead center (FIG. 2), to top dead center (FIG. 3), to top dead center plus 40° (FIG. 4). In FIG. 2, ball 52 is on a low point of cam 46, which is rotated counterclockwise in the Figures. Pistons 56 and 72 are held in their upper positions by their respective springs 60 and 76. Metering compartment 103 is in communication with the fuel supply system through bore 102, slot 100, port 98, slot 92, and passages 90 and 88, all of which are filled with fuel. Further rotation of the crankshaft toward top dead center rotates a steeply inclined lobe **46*a* of cam 46 against ball 52. This initially projects piston 56 downwardly relatively to piston 72 because of the lesser resistance to compression of its spring 60 as compared with that of spring 76, and because, port 98 being in communication with slot 100, piston 56 can displace fuel from the metering compartment 103 back through bore 102, slot 100, port 98, passage 92, and return passages 94 and 96, port 116 not being in communication with passage or passages 114. It will therefore be appreciated that piston 56 meters the amount of fuel in metering chamber 103 according to how much fuel it pumps out of the chamber before slot 100 is moved out of communication with port 98, which in turn depends on the width of slot 100 opposite port 98. Therefore, if piston 72 is rotated by rack 118 to move port 98 toward the wider end of groove 100, less fuel will remain in metering compartment 103** for ultimate injection.

Wen piston 56 has been forced down sufficiently to move slot 100 below port 98 closing the port, piston 56 is no longer able to move relative to piston 72 and forces piston 72 down, exposing port 116 to passage 114, so that piston 56 is again able to move relative to piston 72 by displacing fuel, and completes its stroke to the bottom of metering chamber 103, forcing the metered amount of fuel therein through port 116 and passage 114 onto conical surface 104. Piston 72 is forced suddenly by the steep slope of cam lobe 46 through its main compression stroke to the position shown in FIG. 3, in which it has compressed substantially to half volume the air in the compression chamber 44.

As cam lobe **46*a* moves from its position in FIG. 3 to its position in FIG. 4 its outward slope is more gradual, so that it forces piston 72 to the downward limit of its stroke shown in FIG. 4 more slowly than in its initial compression movement but rapidly enough, at least at high speed, to maintain its displacement substantially equal to the rate of air flow out of orifice 106, so that the air pressure is held nearly constant. The hot, high pressure air forced over the fuel film on surface 104 atomizes and partially vaporizes the fuel and thoroughly mixes with it as it discharges. Cam lobe 46*a* is substantially radial to the cam axis for about 180° rotation from its position in FIG. 4, so that the pistons 56 and 72 remain in the FIG. 4 position during the next crankshaft revolution, and the cam then, being reverse sloped to a smaller radius, permits the springs to return these pistons to the FIG. 2** position.

In a typical example, compression chamber 44 has a displacement of 1.5 $cm^3$; orifice 106 has a diameter of 1.55 mm; the cylinder displacement is 500 $cm^3$ and its clearance volume at top dead center is about 25 $cm^3$; piston 18 compresses the air above it to a peak pressure of about 600 p.s.i. and to a peak temperature of about 1000° F.; and piston 72, in moving from its position of FIG. 2 to its position of FIG. 3, further compresses the air in compression chamber 44 to a pressure of about 1500 p.s.i. and a temperature of about 1400° F., either at high speed or at low speed (r.p.m.) of the engine. At the beginning of the compression stroke of piston 72, the air/fuel flow through orifice 106 rapidly rises to between 20 and 25 grams per second at which "choked" or "solid" air/fuel flow through orifice 106 is attained. At high speed (e.g., 4500 r.p.m.) choked flow is maintained as piston 72 moves from its FIG. 3 to near its FIG. 4 position, since the peak pressure of about 1500 p.s.i. is maintained. At lower speeds, the slower movement of piston 72 between its FIG. 3 and FIG. 4 positions allows the peak air pressure attained in the compression chamber to decay toward the pressure in the cylinder, and the flow rate through orifice 106 correspondingly declines. The mass ratio of air to fuel may be about 1 at maximum fuel charge, and the bulk of the air/fuel injection into the bowl 22 takes place during about 30° rotation of the crankshaft or less.

In the foregoing specific example, the displacement volume of the compression chamber 44 is about 6% of the clearance volume of piston 18 at top dead center, and it is preferred that such displacement volume be between 3% and 12% of such clearance volume. The diameter of orifice 106 is about 1/7th the cube root of the volume of compression chamber 44 and is between 1/25th and 1/100th of the diameter of the bore of piston 18, as is preferred.

FIGS. 5 to 7E show a preferred construction for the tip 112 of head 108 of piston 72, which has a desired action on the air/fuel jet produced thereby into bowl 22. As shown in FIGS. 5 and 6, the conical tip 112 has formed therein grooves 130, four being shown, extending generally helically about the tip from its base toward its axis. On the compression stroke of the piston 72 (FIg. 2 to FIG. 3; FIG. 7A to FIG. 7B) air is compressed in grooves 130. This compressed air in the grooves 130 does not affect the jet J in its initial stages, which starts as a pencil like stream in FIG. 7B expanding somewhat to a cone in FIG. 7C as piston head 108 moves further downward.

However, as piston head 108 approaches the limit of its exhaust stroke in FIGS. 7D and 7E, the pressure in compression chamber 44 rapidly decays, with the result that the air compressed in grooves 130 is released at high pressure and angular momentum, creating a swirl in the chamber which assists in mixing the air with the fuel and increases the angular momentum of the jet, so that it expands to a large angle cone, nearly coextensive with bowl 22. This expansion action improves the uniformity of the combustible mixture in bowl 22 and with which the mixture ignites and burns.

It will be appreciated that fuel can be supplied to base surface 104 of compression chamber 44 by means other than the arrangement shown, such as a connection between fuel inlet passage 114 to surface 104 and a source of metered fuel exterior to piston 72. However, the arrangement shown, utilizing metering piston 56, is preferred. Also, the fuel could be admitted as a jet into compression chamber 44, but the arrangement shown is preferred, since the highly compressed and heated air is able to atomize and mix with the fuel of the film on surface 104 thoroughly and uniformly. It is preferred that fuel injection into the compression compartment take place before piston 72 has completed the compression part of its stroke, but it may occur at least partially during the further exhaust stroke of that piston. A valve could be provided in outlet 106, although the simpler structure shown is preferred.

As stated previously herein, the fuel injection system may be powered hydraulically rather than from the cam shaft if desired. FIG. 8 shows such an arrangement in outline and rather diagrammatically, since the changes from cam shaft to hydraulic operation can be made rather simply and with commercially available equipment.

In FIG. 8, the same parts shown as in FIG. 1 have the same reference numerals. These include the cylinder 12, its piston 18 and operating connections, and cylinder head 38; also, sleeve 42 and compression chamber 44 therein. The piston assembly 40' may be the same as in the previous figures except that its upper part, above flange 82 in FIG. 1, is encased in a cylinder 150 the upper part of which forms an hydraulic pressure cylinder in which a piston (not shown), connected to cap 54 of piston 56 in place of ball 52, is reciprocable. An inlet 152 to this cylinder receives hydraulic fluid under pressure through tubing 154 from an hydraulic pressure fluid delivering pump 156 operated by a cam shaft 48'.

Pump 156 may be a conventional pressurized fuel delivering pump or similar thereto. It may be of the single delivery piston type with a rotary distributor which distributes the fluid to the several cylinders 150 according to the operating cycle, or of the multiple piston type, with a piston for each cylinder 150. In either case, pump 156, as controlled by cam shaft 48', delivers appropriate hydraulic fluid to each cylinder in a pressure pattern which operates the pistons 56 and 72 in the same manner as they are operated by cam 46 acting on ball 52 in the previous figures. A return line (now shown) from cylinders 150 to pump 156 may be provided if needed.

I claim:

1. In an internal combustion engine having at least one cylinder defining a piston chamber, a compression piston reciprocable axially of said chamber, and a cylinder head cooperating with said compression piston while adjacent one end of its stroke to define therewith a combustion chamber wherein air is compressed by said compression piston while moving toward said end of its stroke;

a fuel injection system comprising the combination of:

pressurizing means adjacent said combustion chamber having a compression chamber and a compression means operative to further compress in said compression chamber a relativey small part of the air precompressed by said compression piston in said combustion chamber to a substantially higher pressure and temperature than the peak pressure and temperature of air compressed by said compression piston in said combustion chamber;

fuel feed means including a fuel metering piston coaxial with and internal to said compression piston, said fuel metering piston and said compression piston constrained for relative movement with respect to one another, said fuel metering piston independently movable, said compression piston moved only by movement of said fuel metering piston, said fuel feed means operative only after initiation of compressive action of said compression means to supply a metered quantity of combustible fuel to said compressed body of air in said compression chamber; and nozzle means communicating said compression chamber with said combustion chamber and operative to confine at least most of the air in said compression chamber during said further compression thereof and to discharge said confined compressed air mixed with said fuel as a jet into said combustion chamber.

2. Apparatus according to claim 1 wherein said nozzle means comprises a nozzle body defining in its interior said compression chamber, and said compression means includes a compression piston reciprocable in said compression chamber to enlarge and restrict the volume thereof.

3. Apparatus according to claim 2 wherein said nozzle means includes a discharge outlet continuously open to said combustion chamber and of a small diameter in relation to the volume of said compression chamber such that its capacity for air flow therethrough is substantially less than the air displacement by said compression piston during sudden compression thereby of the air in said compression chamber.

4. Apparatus according to claim 3 wherein the diameter of said outlet is between 1/25th and 1/100th of the diameter of the bore of said cylinder.

5. Apparatus according to claim 3 wherein the end of said compression piston facing said outlet is provided with open-faced grooves at an angle to the axis of said piston.

6. Apparatus according to claim 2 wherein said compression means includes means for suddenly moving said compression piston partially of the length of its stroke in the direction to restrict the volume of said compression chamber to thereby effect said further compression of the air therein, and for thereafter more slowly moving said piston through the remainder of its stroke in said direction during discharge of said further compressed air from said nozzle means.

7. Apparatus according to claim 1 wherein said fuel metering piston is operative, by pressure exerted thereon, to cause the movement of said compression piston in the direction to restrict the volume of said compression chamber.

8. Apparatus according to claim 1 wherein said fuel feed means supplies said combustible fuel to said compression chamber as a film on the wall thereof contiguous to said nozzle means.

9. Apparatus according to claim 8 wherein said wall of said compression chamber is concave and frustoconical about, and coaxial with, the outlet of said nozzle means.

10. Apparatus according to claim 1 wherein said pressurizing means increases the pressure of the further compressed air by at least 100 p.s.i. and its temperature by at least 200° F.

11. Apparatus according to claim 1 wherein the displacement volume of said compression chamber is between 3% and 12% of the clearance volume of said piston at said end of its stroke.

12. Apparatus according to claim 1 wherein said engine has a crankshaft for reciprocating said piston and a cam shaft connected for operation in synchronism with said crankshaft, and said compression means is operatively connected to said cam shaft for operation in synchronism therewith.

13. Apparatus according to claim 1 wherein said pressurizing means includes pressure fluid delivering means connected to operate said compression means.

* * * * *